United States Patent [19]

Barthelemy et al.

[11] Patent Number: 4,682,660

[45] Date of Patent: Jul. 28, 1987

[54] HYDRO-DRILL WITH CIRCULAR IMPRESSION

[75] Inventors: Hervé Barthelemy, La Celle Saint Cloud; Yves Legendre, Balloy, both of France

[73] Assignee: Soletanche, Nanterre, France

[21] Appl. No.: 808,311

[22] Filed: Dec. 12, 1985

[30] Foreign Application Priority Data

Dec. 13, 1984 [FR] France ..... 84 19053

[51] Int. Cl.[4] ..... E21B 10/26

[52] U.S. Cl. ..... 175/96; 175/122; 175/391; 175/413

[58] Field of Search ..... 175/92, 94, 95, 96, 175/259, 265, 113, 122, 412, 413, 385, 386, 391, 104

[56] References Cited

U.S. PATENT DOCUMENTS

| | | | |
|---|---|---|---|
| 1,904,522 | 4/1933 | Pippin | 175/96 |
| 2,360,088 | 10/1944 | Walker | 175/259 |
| 3,322,466 | 5/1967 | Mennekes | 175/96 |
| 3,729,057 | 4/1973 | Werner | 175/262 |
| 3,894,587 | 7/1975 | Sourice | 175/96 |
| 4,446,935 | 5/1984 | Schumacher, Jr. | 175/329 |

FOREIGN PATENT DOCUMENTS

| | | | |
|---|---|---|---|
| 0044817 | 7/1981 | European Pat. Off. . | |
| 0114584 | 12/1983 | European Pat. Off. . | |
| 1224229 | 12/1964 | Fed. Rep. of Germany . | |
| 2733199 | 2/1979 | Fed. Rep. of Germany | 175/94 |
| 0109907 | 5/1984 | France | 175/92 |
| 2028897 | 8/1979 | United Kingdom . | |
| 0537182 | 12/1976 | U.S.S.R. | 175/92 |

*Primary Examiner*—James A. Leppink
*Assistant Examiner*—Terry Lee Melius
*Attorney, Agent, or Firm*—Thomas A. O'Rourke

[57] ABSTRACT

The invention relates to a device for the production of circular boreholes in soil, of the type incorporating a pair of bits driven in rotation in opposite directions, the said bits being equipped with teeth or similar members for breaking up the soil.

It comprises a first pair of bits (6) which are equipped with teeth, rotating in opposite directions around two parallel axes, each of these bits having the external shape of a volume of revolution the generatrix of which consists of a circular arc corresponding to the circular cross-section of the borehole which it is intended to dig, and a second pair of bits (7) situated above the first, and the bits (14*a*,14*b*) of which have the same structural characteristics as the bits of the first pair but whose axes of rotation are offset relative to the latter.

10 Claims, 3 Drawing Figures

HYDRO-DRILL WITH CIRCULAR IMPRESSION

Figure 1:
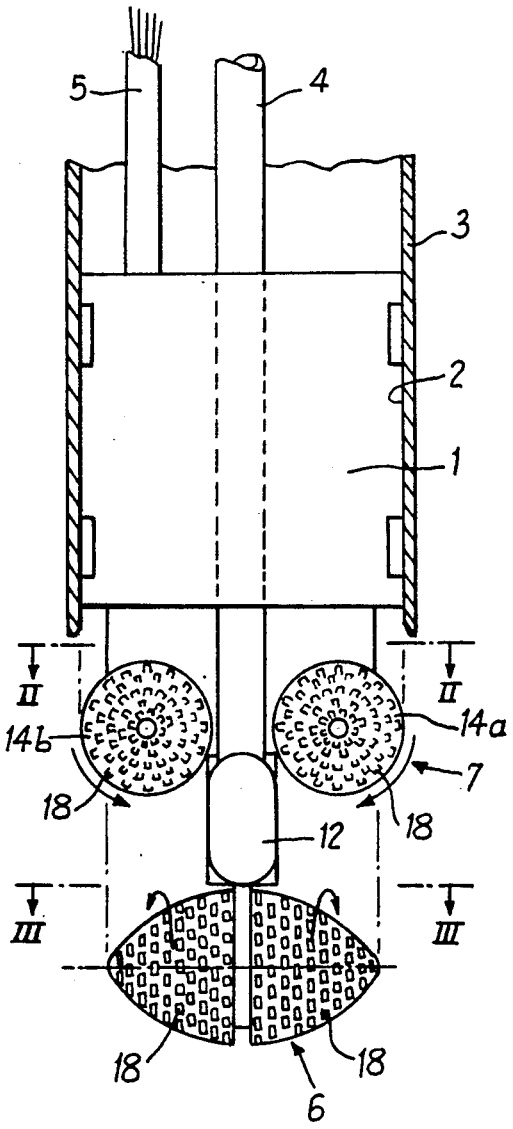

The present invention relates to a device making it possible to produce circular boreholes of a large diameter in soil, such as those employed, for example, for the construction of high-capacity piling or legs of component structures of foundations for maritime platforms for oil exploitation.

Devices are already known for boring holes of a circular cross-section, which incorporate rotary tools which make it possible to break up the ground over a circular area and to lift to the surface the debris thus produced.

Such devices afford good results when the bored orifices are small in diameter but they make it necessary, on the one hand, to subject the rotary tool to a vertical force which applies it against the ground to be broken up and, on the other hand, to impart a considerable rotary torque to the tool.

Now, it is found that the vertical force to be applied, and the torque, attain considerable magnitudes when it is intended to produce holes of a large diameter.

Thus, for example, to bore a well approximately 2.50 m in diameter with the aid of such a device, it is necessary to apply to the tool a vertical force of the order of 100 to 200 tonnes and a very high torque which is difficult to control and to apply, particularly in the case of drilling at sea from a ship.

Drilling machines of the coal-cutter type are known, furthermore, consisting of rotary drums equipped with teeth, combined by pairs and rotating in opposite directions, which make it possible to dig in the ground orifices with a rectangular cross-section, the material originating from the breaking up of the soil being sucked with the drilling mud into tubing situated in the centre of the cavity drilled in this manner.

Such machines do not require the application of an external torque, but they are not capable of producing boreholes with a circular cross-section.

The present invention relates to a relatively lightweight, inexpensive device, which does not exert a reaction torque and which permits the production of circular boreholes of a large diameter.

The subject of the present invention is a device of the type incorporating a pair of bits driven in rotation in opposite directions, the said bits being equipped with teeth or similar members for breaking up the soil, which is characterised in that it comprises (a) a first pair of bits equipped with teeth, rotating in opposite directions around two parallel axes, each of these bits having the external shape of a volume of revolution the generatrix of which consists of a circular arc corresponding to the circular cross-section of the borehole which it is intended to dig, and (b) a second pair of bits situated slightly above the first, which has the same structural characteristics but whose axes of rotation are offset, for example by 90°, relative to the bits of the first pair.

In accordance with the invention, the two pairs of bits may be driven by any suitable means, such as those employed for driving conventional bits.

Thus, driving of the bits according to the invention may be carried out with the aid of hydraulic or electrical motors placed directly in the axis of the bits or in the body of the device which is above the bits, the transmission being then provided by means of chains or transmission shafts and pinions, the electrical or hydraulic energy being conveyed by suitable pipework which runs downwards along the well from the surface of the ground.

The device according to the invention may be used while suspended directly above the hole to be dug, the walls of the cavity produced in this manner being supported by the drilling mud.

In an alternative form, the device according to the invention can also be used inside a metal lining of circular cross-section and the same diameter, which is driven downwards to form the borehole wall.

The soil debris cut from the ground by the bits are advantageously sucked out with the drilling mud by piping arranged preferably in the centre of the device.

It is to be understood that according to the device of the invention each of the bits has a shape of revolution which corresponds substantially to the shape of an olive or a rugby ball, the outline of each bit corresponding to a part of the periphery of the circular borehole to be produced.

It is also to be understood that the pair of bits which is situated in the lower part of the device digs two orifices of a lenticular cross-section, which are situated inside the circular borehole section which is to be produced.

The purpose of the second pair of bits which is situated above the first is to remove the ground which remains between the lenticular section orifices cut by the two bits situated in the bottom part, thus providing the continuity of the circular shape of the borehole which is being produced.

Figure 2:
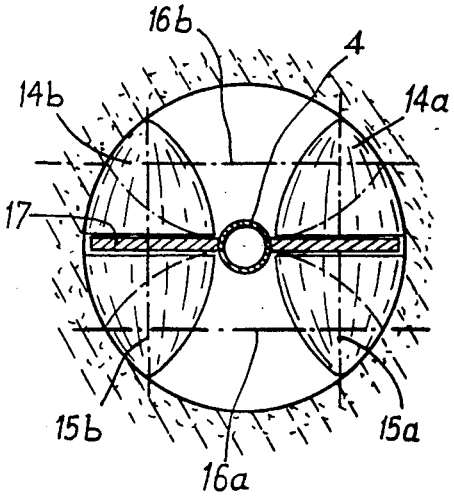
Figure 3:
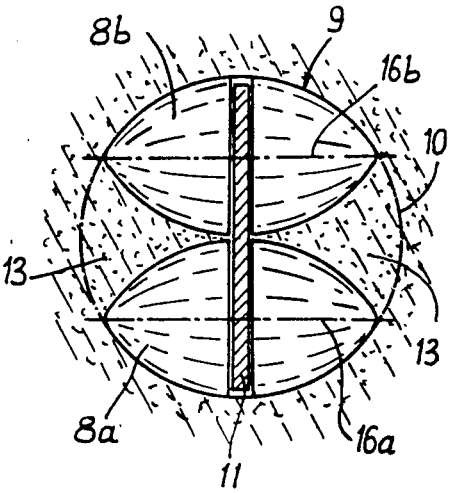

In order to make the invention better understood, an embodiment of it is shown by the attached drawing, in which:

FIG. 1 is a diagrammatic elevation view of a device according to the invention arranged inside a borehole shown in cross-section, FIG. 2 is a view in cross-section along II—II of FIG. 1, and FIG. 3 is a view in cross-section along III—III of FIG. 1.

FIG. 1 shows diagrammatically the body 1 of the device according to the invention which has a cylindrical outer shape 2 the diameter of which is slightly smaller than the diameter of the borehole 3 inside which the device according to the invention can be lowered.

The body 1 of the device incorporates the various members which are required to drive the bits and to pump the mud which is sucked up with the soil debris in order to rise to the surface in the central pipework 4.

Also shown diagrammatically as 5 are the hydraulic or electrical pipeworks which conduct the energy required for driving the bits in rotation.

Shown diagrammatically at the bottom of FIG. 1 is the pair of lower bits 6 and the pair of upper bits 7.

FIG. 3 shows a top view of the pair of lower bits. This pair consists of two bits 8*a* and 8*b* each having the general shape of an olive or a rugby ball.

The generatrices of these bits have the shape of a circular arc 9 corresponding to the section of the borehole 10 which is required to be produced in the ground.

According to this embodiment, the two bits 8*a* and 8*b* are carried by a flat member 11 according to a known method, the motors for driving the bits being capable of being arranged inside the latter while being suspended from and fixed to the plate 11.

According to another embodiment, the bits 8*a* and 8*b* can be driven in accordance with a known method by a motor situated in the body itself of the device 1, the energy being transmitted to them, for example, by chains or transmission shafts, with the aid of pinions and drive tables.

As can be clearly seen in FIG. 3, each bit 8*a* and 8*b* in fact consists of two interchangeable halves which are placed on either side of the flat support member 11, each half being bullet-shaped.

In accordance with the invention, the two bits of the same pair are driven in opposite rotary motions.

In the embodiment shown, the rotary motions are such that the debris which are separated from the soil are brought towards the centre of the device so as to be sucked up by the pump 12 shown diagrammatically in FIG. 1 and to be lifted up through the central pipe 4. This pipe 4 can incorporate, for example, a suction orifice in the region of the lower bits 8*a* and 8*b* together with, advantageously, another suction orifice in the region of the upper bits 14*a* and 14*b*.

However, in another embodiment the bits could turn in the other direction, throwing the debris outwards, that is to say to the periphery of the bored orifice.

It is to be understood that each of the bits 8*a* and 8*b* bores a hole the cross-section of which is clearly shown in FIG. 3, leaving in between them the portions of unexcavated ground having two cross-sections 13 in the shape of curvilinear triangles.

In accordance with the invention, the device incorporates, above bits 8*a* and 8*b*, a second pair of bits 14*a* and 14*b* whose axes 15*a* and 15*b* are arranged at right angles to the axes 16*a* and 16*b* of the bits 8*a* and 8*b*.

These bits 14*a* and 14*b* are also driven in rotation while fixed in a known manner to a flat support 17. FIG. 2 shows the cross-section 4 of the pipe for upward removal of the mud, carrying drilling debris.

As can also be seen in FIGS. 1 and 2, each of the bits 14*a* and 14*b* has the shape of an olive or rugby ball, the generatrices of which correspond to another segment of the circular section of the borehole which is being produced.

Thus, when the circular arcs or circular segment, each of which forms each of the bits at the two levels 6 and 7, are superimposed, a complete circle is obtained.

As a result of the offsetting by 90!° of the axes of rotation of the pair of upper bits relative to the axes of rotation of the pair of lower bits, the two upper bits remove the portions of ground 13 which (as shown in FIG. 3) remain after the passage of the lower bits, which enables an orifice with a perfectly circular cross-section to be produced.

It is clear that, in the usual manner, the bits are equipped on their periphery with teeth 18 which have been shown diagrammatically in FIG. 1 but which, for the sake of clarity, have not been shown in FIGS. 2 and 3.

The device according to the invention, as just described, makes it possible to produce, in a simple and economical manner, with the aid of a machine weighing of the order of 10 to 20 tonnes, boreholes several meters in diameter without any reaction torque being exerted at the surface of the ground.

It is obvious that the embodiment described above is not restrictive in its nature in any way and can undergo any modification without departing thereby from the scope of the invention.

In particular, the invention is not restricted to a single method of driving pairs of bits in rotation or to a single manner of removing waste mixed with the drilling mud. In particular, one would not depart from the field of the invention by providing two suction pipes instead of one.

Furthermore, it would not be a departure from the invention to employ, especially in the upper region, bits with a truncated end and which would thus only have the shape required to complement the circular segments corresponding to the pair of lower bits.

Lastly, it is self-evident that although the device has been designed to produce boreholes of a circular cross-section, it would make it possible, by modification of the shape of the bits, and by choosing the generatrices of the latter differently, to produce boreholes of different cross-sections, such as, for example, boreholes of elliptical cross-sections.

Similarly, the axes of the two pairs of bits are not necessarily at right-angles, provided that the upper bits can lift the soil remaining between the boreholes produced by the lower bits.

We claim:

1. A device for producing generally circular boreholes in the ground comprising a body having an upper and lower pair of bits, a driving means for driving each bit in said pairs of bits in a direction opposite to the direction of rotation of the other bit in said pair said bits having a means for breaking up the soil and wherein said lower pair of bits is capable of rotating in opposite directions by said driving means around two parallel horizontal axes, each of said lower pair of bits having the external shape of a volume of revolution the generatrix of which consists of a circular arc corresponding to the circular cross section of the borehole and wherein said upper pair of bits are above said lower pair of bits and rotate in opposite directions about two parallel horizontal axes which parallel axes are not parallel the axes of said lower pair of bits, each of said upper pair of bits having the external shape of a volume of revolution the generatrix of which consists of a circular arc corresponding to the circular cross-section of the borehole.

2. A device according to claim 1 wherein each bit in said pair of bits are disposed on opposite sides of a support member connected to the underpart of the body.

3. A device according to claim 2 wherein said driving means comprises a motor inside each bit and which is connected to said support member.

4. A device according to claim 2 wherein said driving means comprises at least one motor located in said body.

5. A device according to claim 1 wherein said driving means comprises at least one motor located in said body.

6. A device according to claim 1, 2, 3, 5 or 4 wherein at least one pair of said bits bring the boring debris towards the center of the device.

7. A device according to claims 1, 2, 3, 5 or 4 wherein each bit in at least one pair of bits has the shape of a truncated bullet.

8. A device according to claims 1, 2, 3, 5 or 4 wherein the axes of rotation of said upper pair of bits are perpendicular to the axes of rotation of the lower pair of bits.

9. A device according to claims 1, 2, 3, 5 or 4 wherein said body has a suction orifice connected to at least one pump and located in the region of said lower pair of bits to direct boring debris into a vertical pipe located substantially in the middle of the device.

10. A device according to claim 9 wherein said body has a second suction orifice located in the region of said upper pair of bits.

* * * * *